US006003214A

United States Patent [19]

Lee

[11] Patent Number: 6,003,214

[45] Date of Patent: Dec. 21, 1999

[54] SHOELACE BINDER

[76] Inventor: Hae G. Lee, Kangwon-Do Choonchaun-See Shinbook-Enp Chunjunyook-Rhee Haekang Apt. 101 Dong-211 Ho, Choonchaun, Rep. of Korea

[21] Appl. No.: 09/274,831

[22] Filed: Mar. 23, 1999

[30] Foreign Application Priority Data

Sep. 18, 1998 [KR] Rep. of Korea ..... 98-017750

[51] Int. Cl.[6] ..... A43B 11/00; A43C 7/00

[52] U.S. Cl. ..... 24/712.1; 24/712.2; 24/712.3; 24/713.6

[58] Field of Search ..... 24/712.1, 712, 24/712.2, 712.3, 713.6; 36/50.1

[56] References Cited

U.S. PATENT DOCUMENTS

| | | | |
|---|---|---|---|
| 2,254,579 | 9/1941 | Okie | 24/712.1 |
| 3,122,805 | 3/1964 | Hakim | 24/712.3 |
| 3,176,362 | 4/1965 | Tames | 24/712.2 |
| 3,473,198 | 10/1969 | Meier | 24/712.3 |
| 3,500,508 | 3/1970 | Bennett | 24/712.2 |
| 5,022,127 | 6/1991 | Ang | 24/712.3 |

*Primary Examiner*—Victor N. Sakran
*Attorney, Agent, or Firm*—John K. Park; Law Offices of John K. Park & Associates

[57] ABSTRACT

This present invention relates to a shoelace binder 10 that is designed to prevent a tied shoelace from coming loose. The present invention is comprised of a cover 16 and a base 18. The cover has a body 20 that has a front face 22 and a rear face 24. Two pins, a first pin 26 and a second pin 28, are attached to the front face and the rear face of the cover so that two ends 30 32 of each pin are attached to the front face and the rear face, respectively. The base has two flanges 34 36, each flange having a hole about the middle portion of the flange. Each of the flange holes 38 40 is used to grip a shoelace end 42 46 securely when a shoelace tip 44 48 is inserted into that flange hole, and reinserted into the flange hole from the opposite side after the shoelace has wrapped around one of the pins. An improvement to the invention can be made by the use of elastic materials for the cover.

16 Claims, 3 Drawing Sheets

10

SHOELACE BINDER

CLAIMING FOREIGN PRIORITY

The applicant claims and requests a foreign priority, through the Paris Convention for the Protection of Industry Property, based on a patent application filed in the Republic of Korea (South Korea) with the filing date of Sep. 18, 1998, with the application number 98-17750, by the applicant.

BACKGROUND

This present invention relates to a shoelace binder that is designed to prevent a tied shoelace from coming loose.

An untied or loosen shoelace is a hazardous and unsightly condition that can be prevented. However, the conventional method of tying a double knot or making a tighter knot is difficult and is often prone to loosening. The effect of loose shoelace is that a person can trip over the loose end and it is unsightly.

Another method known is that a person can clip the knot with an alligator clip or a clip that completely encapsulates the entire shoelace ends after making the shoelace ends into a ball. The inventor believes that the use of an alligator clip is, not only unsightly, but also easy to be knocked off the knot, making the clip of a little use. Also, the inventor believes that the use of a clip that encapsulates the balled-up ends of shoelace is unsightly, and uncomfortable to wear on a shoe because it is often quite large in order to cover up the entire volume of the balled-up shoelace ends.

Another method used is the use of hook-and-pile (synthetic materials that adhere when pressed together, commonly sold under the trademark "Velcro") straps to cover the knot. However, the use of these straps over the knot covers a large area of the shoe, altering the style of the shoe significantly and making the shoe look childish. Moreover, the bow look of a conventional shoelace knot and shoelace ends is not preserved.

For the foregoing reasons, there is a need for a new and improved shoelace binder that is comfortable to wear, quick and easy to use, maintains the bow look of the tied shoelace ends at the user's option, and is small.

SUMMARY

This present invention relates to a shoelace binder that is designed to prevent a tied shoelace from coming loose while the binder is comfortable to wear, quick and easy to use, maintaining the bow look of the tied shoelace ends at the user's option, and is small.

The present invention is comprised of a cover and a base. The cover has a body that has a front face and a rear face. Two pins, a first pin and a second pin, are attached to the front face and the rear face of the cover so that two ends of each pin are attached to the front face and the rear face, respectively.

The base has two flanges, a first flange and a second flange. Each of the flanges has a hole about the middle portion of the flange. Each of the flange holes is used to grip a shoelace end securely when a shoelace tip is inserted into that flange hole, and reinserted into the flange hole from the opposite side after the shoelace has wrapped around one of the pins. Because of the shoelace wraps around the pin, the base is removably attached to the cover.

As a variation to the present invention, an improvement can be made to the above-described version by introducing one or more holes on the top face portion of the cover. This top-face hole then can be used to help one or more of the shoelace ends wrap around one or more of the pins, such that one or more of the shoelace tips may be inserted and reinserted through the top-face hole.

Another improvement can be made such that the front face of the cover has one or more lace-tip holes so that a shoelace tip may be inserted into a lace-tip hole for storage. With this version, the shoelace would make a loop such that a bow is formed as the shoelace tip is inserted into the lace-tip hole. Therefore, a pretty bow look of the conventional shoe lace knot is preserved.

Another improvement to this invention is that the base further comprises of a wall between the first flange and the second flange so that the base cannot be pulled in too close to the pins. The wall prevents the pulling action on the shoelace from pulling the base too close to the pins that may break the pins off the cover.

Another improvement can be made so that at least two corners of the cover are made of elastic material so that a user can push two sides of the cover closer together, applying the pressure on each side, to relax the grip of the binder has over the shoelace ends. Also the user can release the pressure off the two sides to allow the two sides to return to their relaxed positions and tighten the grip of the binder has over the shoelace ends. The elasticity of the two sides of the cover allows the adjusting of the relative position of each pin over the respective flange hole, allowing different binding force on the shoelace end.

DESCRIPTIONS OF FIGURES

DETAILED DESCRIPTION

This present invention relates to a shoelace binder 10 that is designed to prevent a tied shoelace 12 from coming loose while the shoelace binder 10 is comfortable to wear, quick and easy to use, maintaining the bow-like shape of the shoelace ends 14 at the user's option, and is small.

Figure 1:
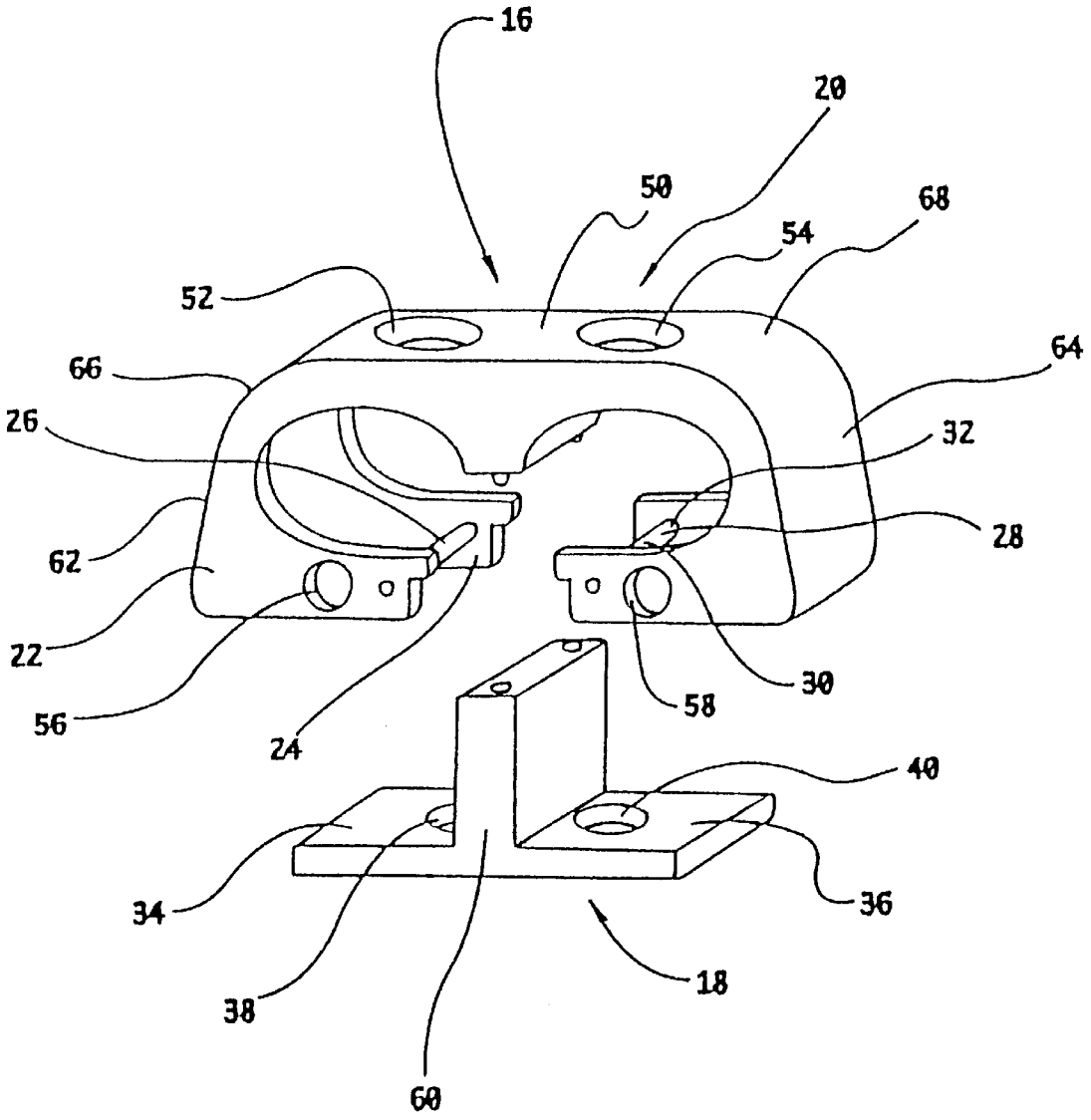
FIG. 1 is a perspective view of the present invention.
Figure 2:
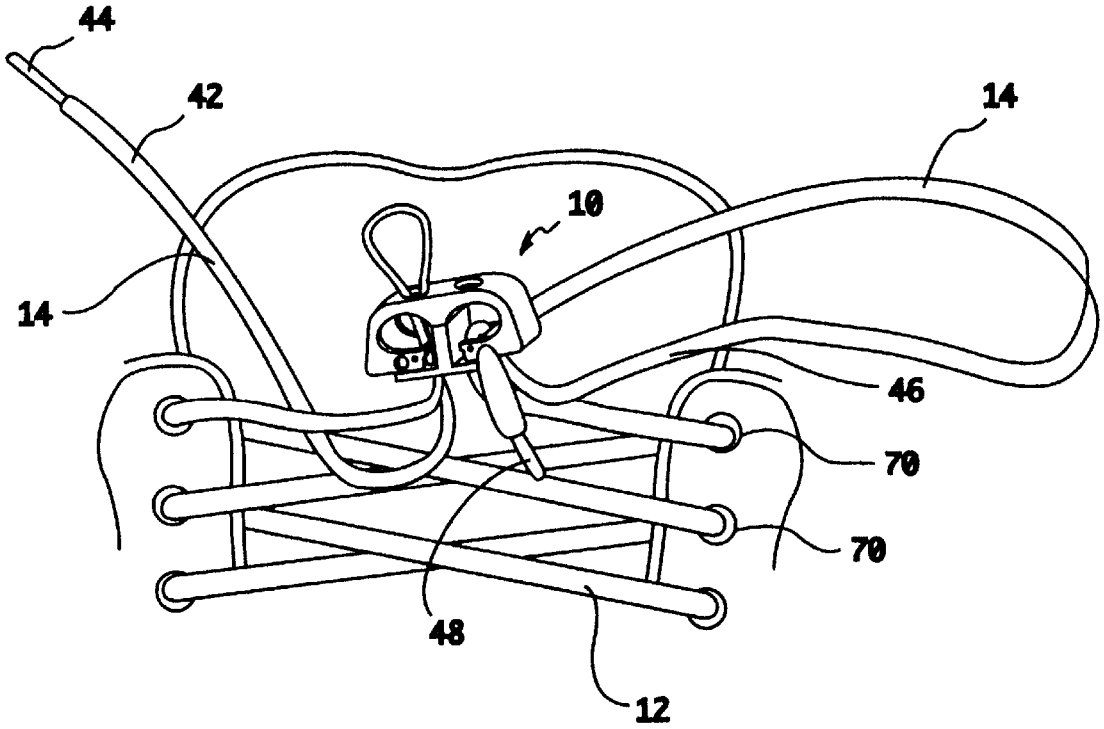
FIG. 2 is a perspective view of the present invention used with a shoelace.

Referring to the drawings, FIG. 1 and FIG. 2 show the present invention comprised of a cover 16 and a base 18. The cover 16 has a body 20 that has a front face 22 and a rear face 24. The cover 16 also has a first pin 26 and a second pin 28 which are attached to the front face 22 and the rear face 24 of the cover 16. Each of the first pin 26 and the second pin 28 has a front end 30 and a rear end 32 so that each of the front ends 30 is attached to the front face 22 and each of the rear ends 32 is attached to the rear face 24.

The base 18 has a first flange 34 and a second flange 36. The first flange 34 has a first flange hole 38 and the second flange 36 has a second flange hole 40 so that the first shoelace end 42 (as shown in FIG. 2) is gripped securely by having the first shoelace tip 44 (as shown in FIG. 2) inserted into the first flange hole 38 and reinserted into the first flange hole 38 from the opposite side after the first shoelace end 42 has wrapped around the first pin 26, and the second shoelace end 46 is gripped securely by having the second shoelace tip 48 inserted into the second flange hole 40 and reinserted into the second flange hole 40 from the opposite side after the second shoelace end 46 has wrapped around the second pin 28. Because a shoelace end 42 46 wraps around a pin 26 28, and the shoelace end 42 46 threads the flange holes 38 40, making a loop around the pin 26 28, the base 18 is removably attached to the cover 16.

The cover 16 further comprises of a top face 50 having a first top-face hole 52 so that one or more of the shoelace tips 44 48 may be inserted and reinserted through the first top-face hole 52 to help one or more of the shoelace ends 42 46 wrap around one or more of the pins 26 28. This first top-face hole 52 is very useful in that as a shoelace tip 44 48 is inserted toward the first top-face hole 52 from either the first flange hole 38 or the second flange hole 40, the shoelace tip 44 48 can be pushed through the top face 50 of the cover 16 on one side of the pin 26 28. Afterwards, the shoelace tip 44, 48 can be reinserted into the first top-face hole 52 on the opposite side of the pin 26, 28, and inserted into the same flange hole 38, 40. Without at least one top-face hole, it would be a difficult task to have a shoelace end wrap around a pin due to the confined and small space within the cover 16. Afterwards, the shoelace tip 44 48 or the shoelace end 42 46 can be pulled away from the binder 10 to tighten and securely bind the shoelace tightly, preventing the shoelace from loosening.

The preferred version of this invention is that the cover 16 has not only the first top-face hole 52, but also a second top-face hole 54. The function of the second top-face hole 54 is same as that of the first top-face hole 52, except that because of two separate top-face holes 52 54, the user can have the first top-face hole 52 designated solely for the first shoelace tip 44 and the first shoelace end 42, and the second top-face hole 54 designated solely for the second shoelace tip 48 and the second shoelace end 46.

FIG. 2 shows the binder 10 in use. The left side of FIG. 2 shows the first shoelace end 42 prior to the user having pulled the first shoelace end 42 to the final tightened position; thus, the first shoelace end 42 still having a large loop around the pin, with the loop protruding through the first top-face hole 52. This left side of FIG. 2 illustrates the significance and the usefulness of the first top-face hole 52. The right side of FIG. 2 shows the second shoelace end 46 after the user has pulled the second shoelace end 46 to the final tightened position. It is recommended that if the cover 16 only has the first top-face hole 52, then the first top-face hole 52 should be sufficiently large so either shoelace end 42, 46 may be easily inserted into the first top-face hole 52.

Referring back to FIG. 1, the front face 22 can also have a first lace-tip hole 56 so that the first shoelace tip 44 may be inserted into the first lace-tip hole 56 for storage. Also, preferred version would have a second lace-tip hole 58 so that the second shoelace tip 48 may be inserted into the second lace-tip hole 58 for storage. These lace-tip holes 56 58 allows not only the storage of the shoelace tips 44 48, but also the shoelace ends 42 46 to form a bow or a ribbon as in a conventional knot, maintaining the beautiful appeal of a conventional knot.

A preferred version of the invention would have the base 18 further comprising of a wall 60 between the first flange 34 and the second flange 36 so that the flanges 34 36 cannot be pulled in too close to the pins, preventing the pins from breaking off the cover 16 when the user forcibly tightens the shoelace ends 42 46 too much. The wall 60 would ensure that the base 18 would only be pulled to a predetermined distance from the pins 26 28.

A more preferred version of the present invention would have the cover 16 further comprising of a left face 62 and a right face 64 wherein the left face 62 is attached to the top face 50 forming a first corner 66 and the right face 64 is attached to the top face 50 forming a second corner 68, wherein the first corner 66 and the second corner 68 are made of elastic material. When the first corner 66 and the second corner 68 are made of elastic material, then the user can push the left face 62 and the right face 64 closer together to relax the grip the binder 10 has over the shoelace ends, and the user can release the left face 62 and the right face 64, allowing the left face 62 and the right face 64 to return to their relaxed positions, tightening the grip of the binder 10 has over the shoelace ends 42 46. The possible elastic material should be, and not limited to, steel, aluminum, cooper, other metals, plastic or perhaps rubber which would allow the left face 62 and the right face 64 to be pushed closer with the pressure of a thumb and another finger and that which would allow the left face 62 and the right face 64 to return to their original position when the pressure applied by the fingers are released.

Figure 3:
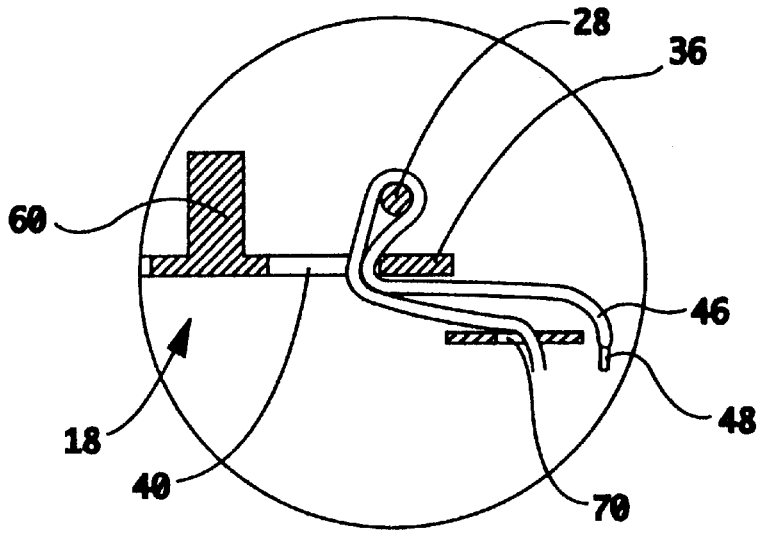
FIG. 3 is an exploded view of a cross-section of the shoelace binder, used with a shoelace, in a relaxed position.

FIG. 3 illustrates a configuration of the binder 10 while the cover 16 (cover 16 represented by the pin 26 28) is in a relaxed position, after the shoelace end has been fully tightened and bound by the binder 10. The shoelace end exiting a shoe eyelet 70 is shown having passed through one of the flange holes 38 40, wrapped around one of the pins 26 28 of the cover 16, and passed through the same flange hole once again. As the shoelace end 42, 46 is pulled out tightly, the friction from the shoelace end tightly wrapping around the pin 26, 28, the eyelet 70, and the flange hole 38 40 maintains the shoelace 12 bound.

Moreover, if the first corner 66 and the second corner 68 are made of elastic material, then the elasticity of the material around the corners 66 68 would apply additional binding force around the shoelace end 42, 46. Therefore, higher value in the elasticity of the material is preferred, but the elasticity should be limited to the elasticity producing force that can be easily countered by the strength of two human fingers applying a counter force.

Figure 4:
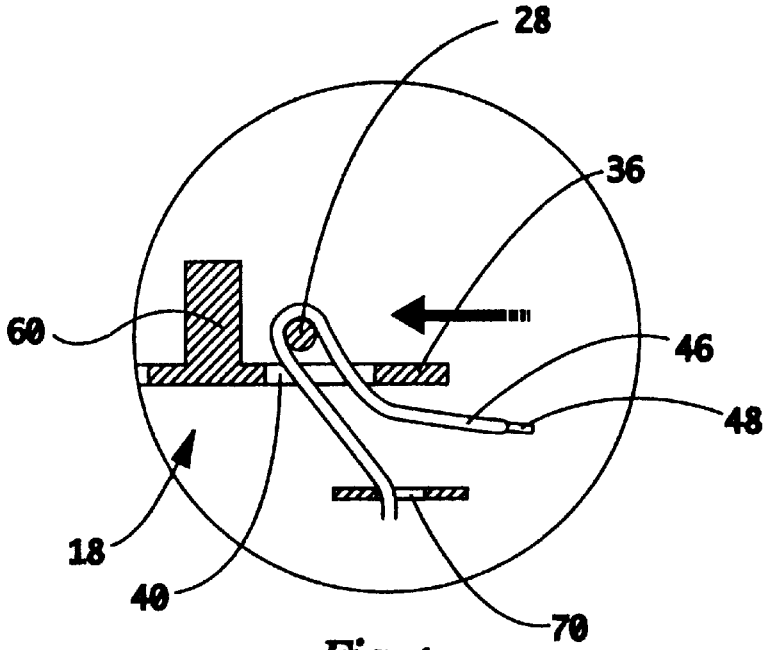
FIG. 4 is another exploded view of a cross-section of the shoelace binder, used with a shoelace, in a squeezed position.

FIG. 4 shows the binder 10 with the left face 62 and the right face 64 pushed toward the center of the cover 16, making the pins closer to the wall 60 of the base 18 (cover 16 represented by the pin 26 28). As the pin 26 28 is pushed directly over the flange hole 38 40, the friction and the binding force applied to the shoelace end 42 46 is lessened, making the loosening of the shoelace 12 much easier.

One of the greatest benefits of the present invention with the elastic corners 66 68 is that once the binder 10 is properly placed on the shoelace 12, as shown in FIG. 2, the shoelace 12 can be easily tightened by pulling on a shoelace end until the shoelace 12 is taught, and the shoelace 12 can be easily loosened by pressing the left face 62 and the right face 64 together. As the left face 62 and the right face 64 are pressed together, the cover 16 can also be easily pulled away from the shoe, making the removal of the shoe easy.

Another advantage is that this binder 10 is especially useful for kids who are not hand coordinated enough to make the shoelace knots themselves. Because kids cannot make the shoelace knots tightly and they are very active, they are the ones who would greatly benefit. Parents can help the kids by putting on the binder 10 on the kids' shoes, and then the kids can simply pull on the shoelace ends to adjust the tightness of the shoelace 12 on their shoes. The use of the binder 10 can also reduce the accidents kids have when they trip over loose shoelace ends 42 46.

Although the invention has been described in considerable detail with reference to certain preferred versions thereof, other versions are possible. For example, a creative design may result in an embodiment that having differently shaped or sized cover 16.

What I claim is:

1. A shoelace binder to prevent a shoelace from becoming loosened, wherein the shoelace has a first shoelace end ending with a first shoelace tip and a second shoelace end ending with a second shoelace tip, comprising:

a) a cover comprising a body, a front face, a rear face, a first pin and a second pin, wherein each of the first pin and the second pin having a front end and the rear end so that each of the front ends is attached to the front face and each of the rear ends is attached to the rear face; and b) a base removably attached to the cover by the use of the shoelace, wherein the base comprises of a first flange, and a second flange, wherein the first flange has a first flange hole and the second flange has a second flange hole so that i) the first shoelace end is gripped securely by having the first shoelace tip inserted into the first flange hole and reinserted into the first flange hole after the first shoelace end has wrapped around the first pin, and ii) the second shoelace end is gripped securely by having the second shoelace tip inserted into the second flange hole and reinserted into the second flange hole after the second shoelace end has wrapped around the second pin.

2. The shoelace binder of claim 1 wherein the cover further comprises of a top face having a first top-face hole so that one or more of the shoelace tips may be inserted and reinserted through the first top-face hole to help one or more of the shoelace ends wrap around one or more of the pins.

3. The shoelace binder of claim 1 wherein the cover further comprises of a top face having a first top-face hole and a second top-face hole so that the first shoelace tips may be inserted and reinserted through the first top-face hole to help the first shoelace end wrap around the first pin, and the second shoelace tips may be inserted and reinserted through the second top-face hole to help the second shoelace end wrap around the second pin.

4. The shoelace binder of claim 3 wherein the front face of the cover has a first lace-tip hole so that the first shoelace tip may be inserted into the first lace-tip hole for storage.

5. The shoelace binder of claim 4 wherein the front face of the cover also has a second lace-tip hole so that the second shoelace tip may be inserted into the second lace-tip hole for storage.

6. The shoelace binder of claim 5 wherein the base further comprises of a wall between the first flange and the second flange so that the first flange and the second flange cannot be pulled in too close to the pins to prevent the pins from breaking off the cover.

7. The shoelace binder of claim 1 wherein the cover further comprises of a left face and a right face wherein the left face is attached to the top face forming a first corner and the right face is attached to the top face forming a second corner, wherein the first corner and the second corner are made of one or more elastic materials, so that a user can push the left face and the right face closer together to relax the grip the binder has over the shoelace ends and that the user can release the left face and the right face, allowing the left face and the right face to return to their relaxed positions, tightening the grip of the binder has over the shoelace ends.

8. The shoelace binder of claim 7 wherein the cover further comprises of a top face having a first top-face hole so that one or more of the shoelace tips may be inserted and reinserted through the first top-face hole to help one or more of the shoelace ends wrap around one or more of the pins.

9. The shoelace binder of claim 7 wherein the cover further comprises of a top face having a first top-face hole and a second top-face hole so that the first shoelace tips may be inserted and reinserted through the first top-face hole to help the first shoelace end wrap around the first pin, and the second shoelace tips may be inserted and reinserted through the second top-face hole to help the second shoelace end wrap around the second pin.

10. The shoelace binder of claim 9 wherein the front face of the cover has a first lace-tip hole so that the first shoelace tip may be inserted into the first lace-tip hole for storage.

11. The shoelace binder of claim 10 wherein the front face of the cover also has a second lace-tip hole so that the second shoelace tip may be inserted into the second lace-tip hole for storage.

12. The shoelace binder of claim 11 wherein the base further comprises of a wall between the first flange and the second flange so that the first flange and the second flange cannot be pulled in too close to the pins to prevent the pins from breaking off the cover.

13. The shoelace binder of claim 7 wherein the entirety of the cover is made of one or more elastic materials.

14. The shoelace binder of claim 13 wherein the elastic material is metal.

15. The shoelace binder of claim 13 wherein the elastic material is aluminum.

16. The shoelace binder of claim 13 wherein the elastic material is plastic.

* * * * *